US011019908B1

(12) United States Patent
Schmidt

(10) Patent No.: US 11,019,908 B1
(45) Date of Patent: Jun. 1, 2021

(54) SHAVING BRUSH AND APPLICATOR

(71) Applicant: Kevin Schmidt, Franklin Lakes, NJ (US)

(72) Inventor: Kevin Schmidt, Franklin Lakes, NJ (US)

( * ) Notice: Subject to any disclaimer, the term of this patent is extended or adjusted under 35 U.S.C. 154(b) by 0 days.

(21) Appl. No.: 16/852,739

(22) Filed: Apr. 20, 2020

(51) Int. Cl.
*A46B 5/02* (2006.01)
*A45D 34/04* (2006.01)

(52) U.S. Cl.
CPC ..... *A45D 34/042* (2013.01); *A45D 2200/10* (2013.01)

(58) Field of Classification Search
CPC ..... A45D 34/042
USPC ..... 401/190
See application file for complete search history.

(56) References Cited

U.S. PATENT DOCUMENTS 8,475,070 B1 * 7/2013 Miner ..... A46B 11/0017 401/190
8,893,933 B2 * 11/2014 Ohshima ..... B65D 83/285 222/402.13
8,939,158 B2 * 1/2015 Mercier ..... A61K 8/72 132/112
9,364,068 B2 * 6/2016 Kodama ..... A45D 34/042
D784,704 S 4/2017 Gutow et al.
9,706,832 B2 * 7/2017 Price ..... A46B 11/0089
9,914,581 B2 3/2018 Gutow et al.
D850,116 S 6/2019 Schmidt

* cited by examiner

*Primary Examiner* — Jennifer C Chiang
(74) *Attorney, Agent, or Firm* — Greenberg Traurig, LLP

(57) ABSTRACT

An applicator having an upper cap with a base having a first tubular member and a feed tube, a free end of which extends from the base, and an opposite end adapted to engage a container valve such as an aerosol can. The applicator includes a lower cap having a second tubular member adapted to be removably attached to the container. The upper cap is attached to the lower cap such that the first tubular member is slidably inserted into the second tubular member. The upper cap is movable relative to the lower cap from a first position, in which the feed tube free end is disengaged with the valve, and a second position, in which the opposite end of the feed tube is engaged with the container valve and pushes it to an engaged position such that container contents are released through the feed tube.

25 Claims, 8 Drawing Sheets

SHAVING BRUSH AND APPLICATOR

FIELD OF THE INVENTION

The present invention relates to an applicator and, more particularly, an applicator that is adapted to be attached to a shaving cream can to dispense shaving cream/gel to a shaving brush attached to the applicator.

BACKGROUND OF THE INVENTION

Applicators are used for dispensing liquids and foams for various uses. What is needed is an applicator having a shaving brush that is adapted to be easily attached to a shaving cream can and facilitate dispensing the shaving cream or gel directly to the shaving brush in an easy and efficient manner.

SUMMARY OF THE INVENTION

In an embodiment, an applicator, comprising an upper cap including a base having a first end, a second end opposite the first end, a first tubular member extending from the first end of the base and having an interior portion, and a feed tube having a first end located within the interior portion of the first tubular member, and a second end extending outwardly from the second end of the base, wherein the first end of the feed tube is adapted to engage a valve extending from a first end of a container; and a lower cap having a first end, a second end opposite the first end of the lower cap, an interior portion extending between the first end of the lower cap and the second end of the lower cap, and a second tubular member extending inwardly from the second end of the lower cap, wherein the first end of the lower cap is adapted to be removably attached to the first end of the container, wherein the upper cap is attached to the lower cap such that the first tubular member of the upper cap is slidably inserted into the second tubular member of the lower cap, wherein the upper cap is movable longitudinally relative to the lower cap from a first position, in which the first end of the feed tube is disengaged with the valve of the container, and a second position, in which the first end of the feed tube is engaged with the valve of the container and pushes the valve to an engaged position such that contents of the container are released therefrom and conveyed through the feed tube and expelled from the second end of the tube.

In an embodiment, the first tubular member of the upper cap includes a first end, a second end opposite the first end of the first tubular member, and at least one locking tab extending from the second end of the first tubular member, wherein the second tubular member of the lower cap includes a first end and a second end opposite the first end of the second tubular member, and wherein the at least one locking tab of the first tubular member of the upper cap is adapted to releasably engage the second end of the second tubular member of the lower cap. In an embodiment, the second tubular member of the lower cap includes an inner wall and at least one pin extending radially inwardly from the inner wall proximate to the second end thereof, wherein the first tubular member of the upper cap includes a wall having at least one first slot formed therein and extending from the second end of the first tubular member to a closed end intermediate the first and second ends of the first tubular member, and at least one second slot circumferentially formed therein and extending from the corresponding at least one first slot, wherein each of the at least one first and second slots is adapted to receive a corresponding one of the at least one pin such that upper cap and the lower cap are moveable relative to one another from an unlocked position, in which the at least one pin is positioned in the at least one slot and the upper cap is moveable longitudinally relative to the lower cap, and a locked position, in which the upper cap is rotatable relative to the lower cap and the at least one pin is positioned within the at least one second slot such that the upper cap is inhibited from moving longitudinally relative to the lower cap.

In an embodiment, the at least one pin includes two pins, the at least one first slot includes two first slots, and the at least one second slot includes two second slots, wherein the two pins are diametrically opposed to one another, and each pair of corresponding first and second slots are diametrically opposed to one another. In an embodiment, the lower cap includes an inner wall and at least one snap tab extending from and circumferentially on the inner wall and located proximate to the first end of the lower cap, and wherein the at least one snap tab is adapted to removably engage the first end of the container to removably install the applicator on the container. In an embodiment, the at least one snap tab includes a plurality of snap tabs.

In an embodiment, the lower cap includes an outer wall opposite the inner wall of the lower cap and at least one enlarged tab extending from the outer wall of the lower cap, and wherein the at least one enlarged tab is sized and shaped to facilitate the installation of the applicator, and release of the applicator from, the container. In an embodiment, the base of the upper cap includes an outer wall having gripping means. In an embodiment, the gripping means includes a plurality of ribs. In an embodiment, the gripping means includes a plurality of gripping dots. In an embodiment, the gripping means includes a tactile material.

In an embodiment, the feed tube includes an inner wall that tapers radially outwardly from the first end of the feed tube to the second end of the feed tube.

In an embodiment, the applicator further comprises a brush adapted to be slidably attached to the tube. In an embodiment, the base of the upper cap includes a centrally located recess formed within the second end thereof, and wherein the brush includes a brush base that is sized and shaped to be installed within the recess of the base of the upper cap. In an embodiment, the brush base is attached to the upper cap by an adhesive. In an embodiment, the brush includes a shaving brush having a bulb with a plurality of bristles, and the container includes an aerosol shaving can, the contents of which being shaving fluid, and wherein the shaving fluid is fed through the feed tube to the bristles of the shaving brush. In an embodiment, the bulb is recessed within the recess of the upper cap. In an embodiment, the shaving fluid is selected from the group consisting of shaving cream and shaving gel. In an embodiment, the container includes an aerosol paint can, the contents of which being paint.

In an embodiment, the first tubular member of the upper cap includes at least one bayonet clip stop located at the second end of the first tubular member. In an embodiment, the wall of the first tubular member of the upper cap includes an outer wall and a plurality of ribs extending from the outer wall and from the first end of the first tubular member to the second end of the first tubular member, and wherein the plurality of ribs is adapted to reduce friction between the outer wall of the first tubular member of the upper cap and the inner wall of the second tubular member of the lower cap. In an embodiment, the applicator is adapted to dispense the contents of the container inline and axially through the feed tube. In an embodiment, the feed tube includes a valve positioned at the second end thereof, wherein the valve of the feed tube includes a one-way slit to enable the release of the contents from the container.

In an embodiment, wherein the lower cap includes at least one rib extending radially inwardly from the inner wall of the lower cap. In an embodiment, at least one rib includes a plurality of ribs.

DETAILED DESCRIPTION OF THE EMBODIMENTS

Figure 1:
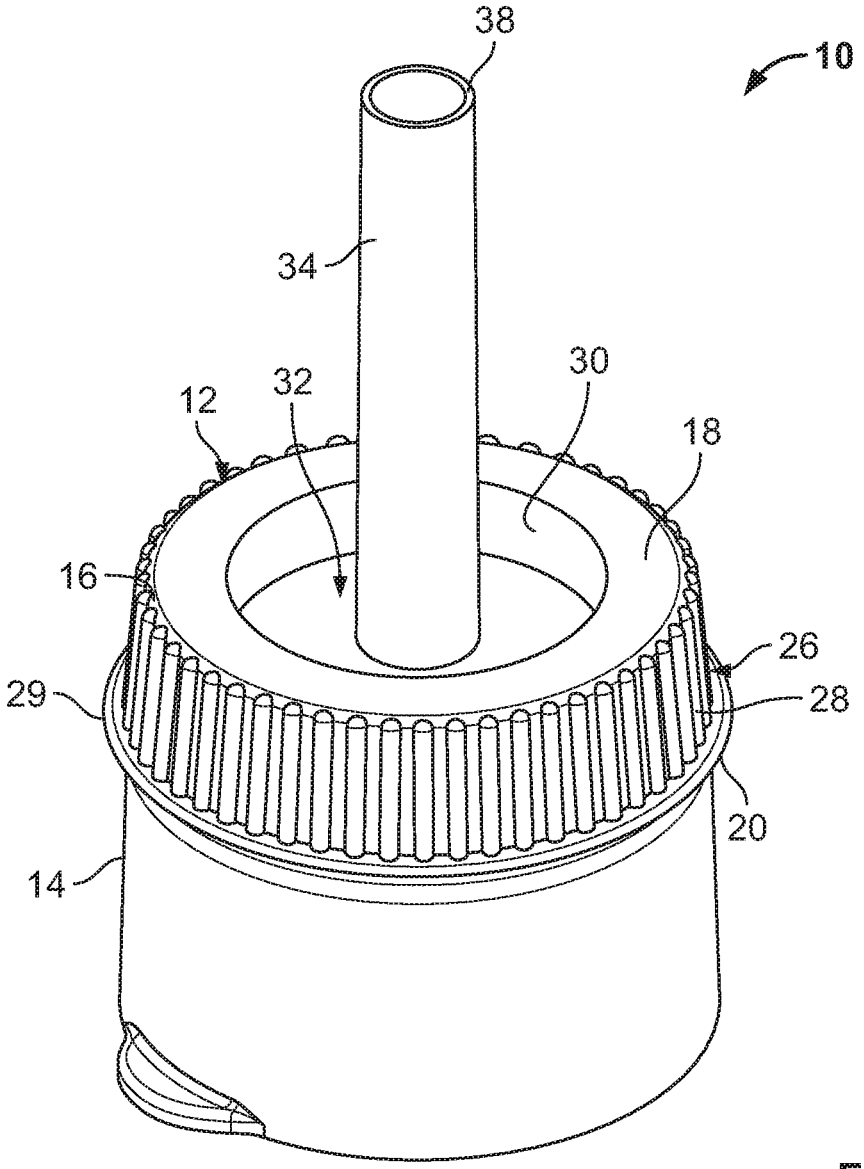
FIG. 1 is a top perspective view of an embodiment of an applicator.

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

Among those benefits and improvements that have been disclosed, other objects and advantages of this invention can become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given regarding the various embodiments of the present invention is intended to be illustrative, and not restrictive.

Throughout the specification, the following terms take the meanings explicitly associated herein, unless the context clearly dictates otherwise. The phrases "in an embodiment," "in one embodiment," "in other embodiments," and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention. Further, when a feature, structure, or characteristic is described regarding an implementation, it is submitted that it is within the knowledge of one skilled in the art to affect such feature, structure, or characteristic regarding other implementations whether or not explicitly described herein.

The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Figure 3:
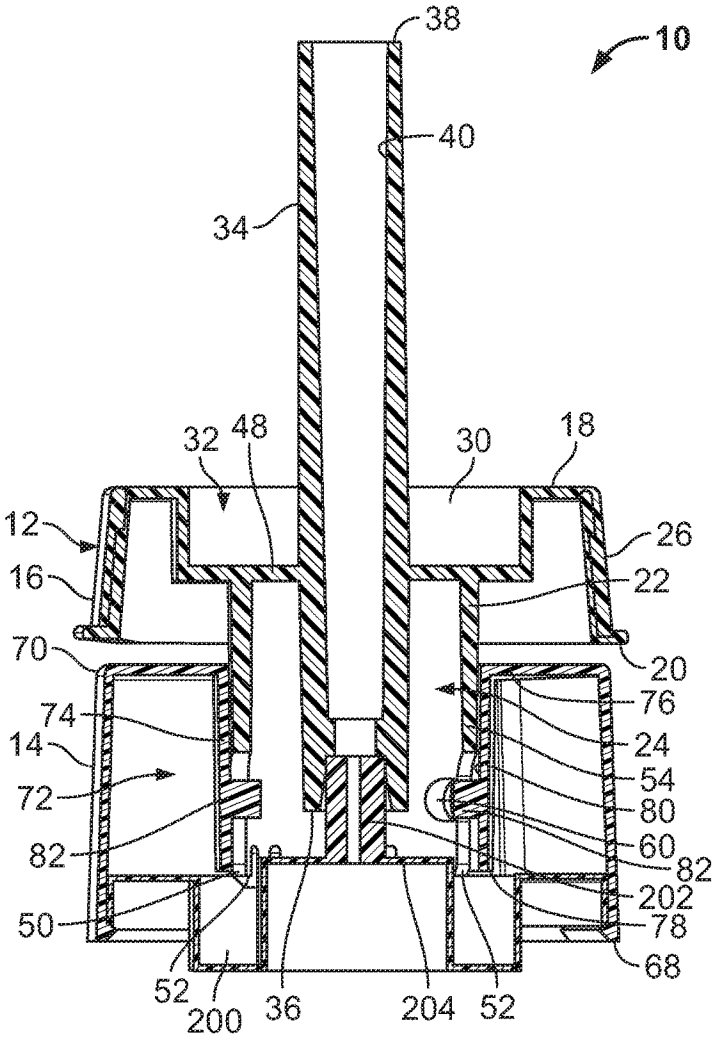
FIG. 3 is cross-sectional view, taken along lines 3-3 and looking in the direction of the arrows, of the applicator of FIG. 2, and attached to a container.
Figure 2:
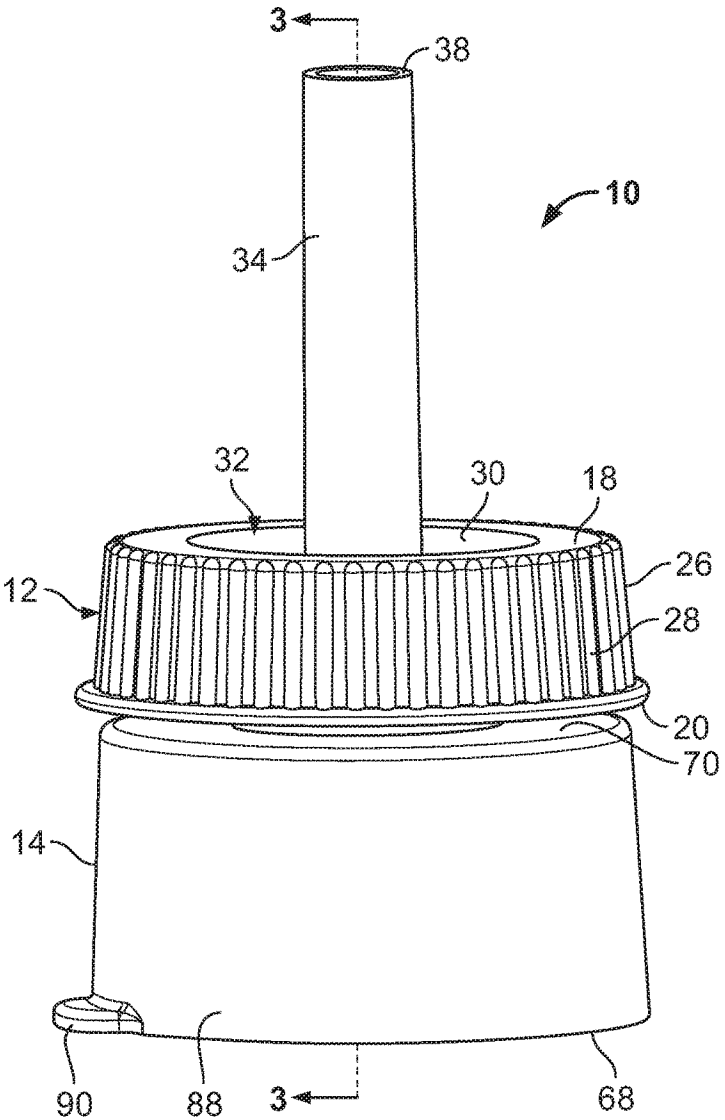
FIG. 2 is a side elevational view of the applicator of FIG. 1.

Referring to FIGS. 1 through 3, in an embodiment, an applicator 10 includes an upper cap 12 and a lower cap 14 releasably attached to the upper cap 12. In an embodiment, the upper cap 12 and the lower cap 14 are made of plastic. In an embodiment, the upper cap 12 and the lower cap 14 are made of polypropylene. In other embodiments, the upper cap 12 and the lower cap 14 are made of other suitable materials known in the art. In an embodiment, the upper cap 12 includes a base 16 having a first end 18, a second end 20 opposite the first end 18, and a first tubular member 22 extending from the first end 18 of the base 16 and having an interior portion 24. In an embodiment, the base 16 is frusto-conical in shape. In another embodiment, the base 16 is disc-shaped. In an embodiment, the base 16 of the upper cap 12 includes an outer wall 26 having gripping means. In an embodiment, the gripping means includes a plurality of ribs 28. In another embodiment, the gripping means includes a plurality of gripping dots. In another embodiment, the gripping means includes a tactile material. In an embodiment, the base 16 includes an annular ring 29 proximate to the second end 20 thereof. In an embodiment, one end of each of the plurality of ribs 28 extends to the ring 29. In an embodiment, the base 16 of the upper cap 12 includes a centrally located wall 30 extending within the second end 20 of the base 16, the wall 30 forming a recess 32. In an embodiment, the wall 30 is ring-shaped and the recess 32 is an annular recess. In other embodiments, the wall 30 may consist of other shapes and sizes, such as square, triangular, elliptical, polygonal, etc. The purpose and function of the wall 30 and the recess 32 will be described hereinafter.

Referring to FIGS. 1 through 6, in an embodiment, the upper cap 12 includes a feed tube 34 having a first end 36 located within the interior portion 24 of the first tubular member 22, and a second end 38 extending outwardly from the second end 20 of the base 16. In an embodiment, the feed tube 34 is centrally located. In an embodiment, the first end 36 of the feed tube 34 is adapted to engage a valve 202 extending from a first end 204 of a container 200. In an embodiment, the container 200 is an aerosol can and the valve 202 is an aerosol valve. In an embodiment, the feed tube 34 includes an inner wall 40 that tapers radially outwardly from the first end 36 of the feed tube 34 to the second end 38 of the feed tube 34. In an embodiment, the applicator 10 includes a tubular-shaped valve 42 that is slidably attached to the second end 38 of the feed tube 34. In an embodiment, the valve 42 is made from a flexible material and includes a first end 44 having a slit 46. In an embodiment, the slit 46 is cross-shaped. In another embodiment, the slit 46 is linear. In embodiment, the valve 42 is made of silicone.

Figure 5:
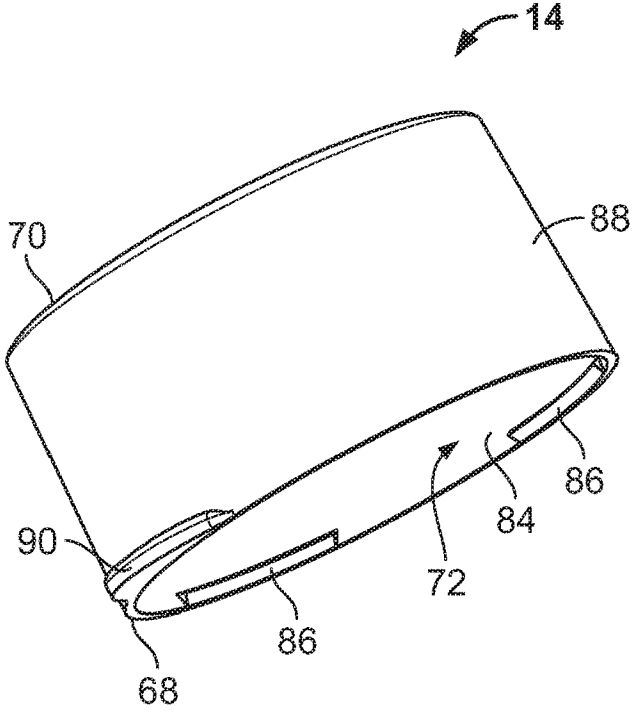
FIG. 5 is perspective view of a lower cap employed by the applicator of FIG. 1.
Figure 4:
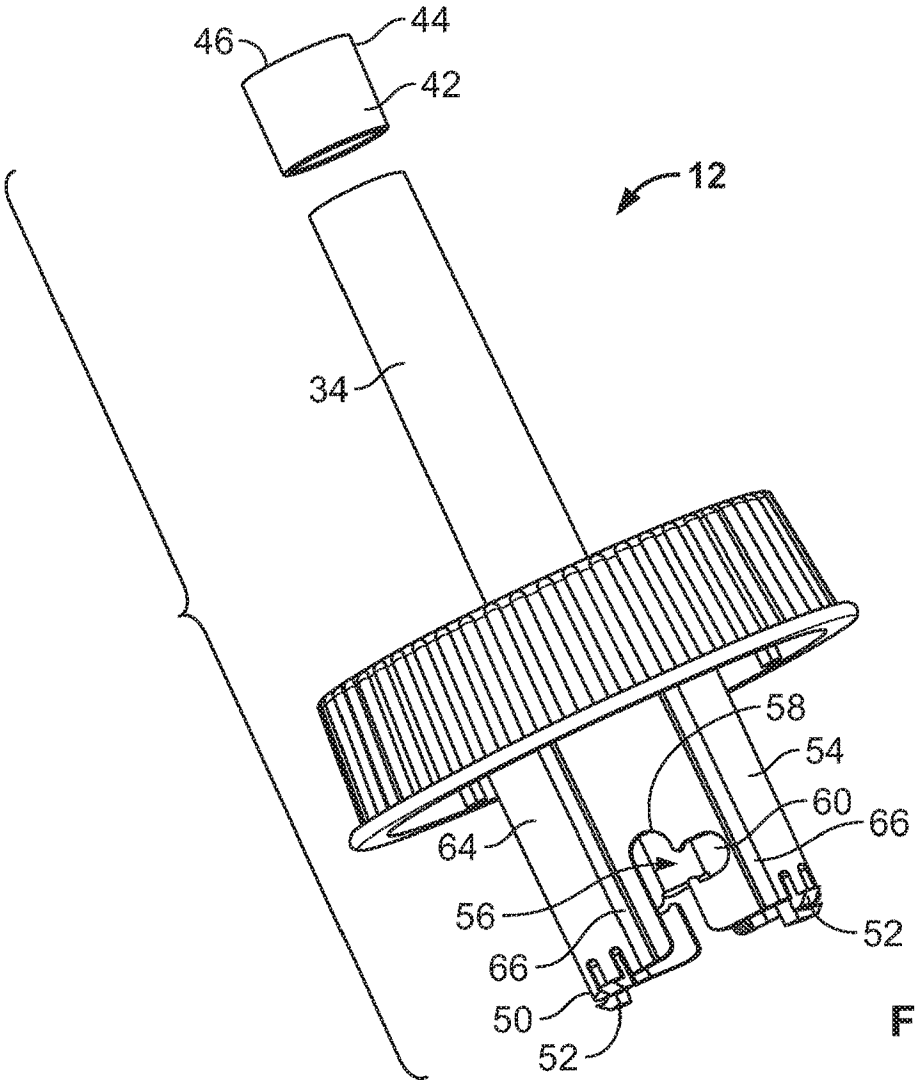
FIG. 4 is perspective view of an upper cap employed by the applicator of FIG. 1.
Figure 6:
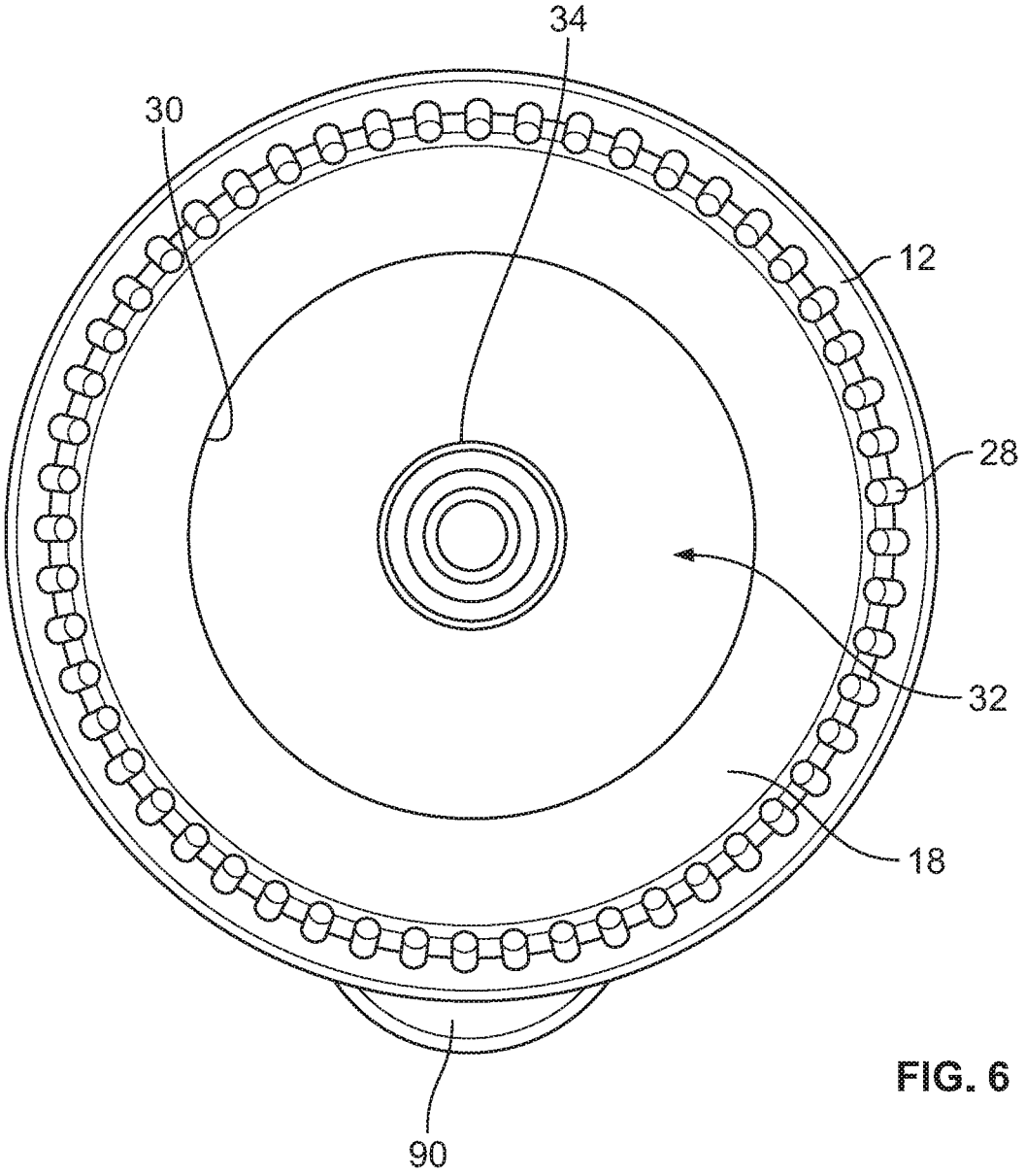
FIG. 6 is a top plan view of the applicator of FIG. 1.

Still referring to FIGS. 1 through 6, in an embodiment, the first tubular member 22 of the upper cap 12 includes a first end 48, a second end 50 opposite the first end 48 of the first tubular member 22, and at least one locking tab 52 extending from the second end 50 of the first tubular member 22. In an embodiment, the at least one locking tab 52 includes a plurality of locking tabs 52. In an embodiment, the first tubular member 22 of the upper cap 12 further includes a wall 54 having at least one first slot 56 formed therein and extending from the second end 50 of the first tubular member 22 to a closed end 58 intermediate the first and second ends 48, 50 of the first tubular member 22, and at least one second slot 60 circumferentially formed therein and extending from the corresponding at least one first slot 56. In an embodiment, the at least one first slot 56 includes two first slots 56, and the at least one second slot 60 includes two second slots 60. In an embodiment, each pair of corresponding first and second slots 56, 60 are diametrically opposed to one another. In an embodiment, the first tubular member 22 of the upper cap 12 includes at least one bayonet clip stop located at the second end 50 of the first tubular member 22. Referring to FIG. 5, in an embodiment, the wall 54 of the first tubular member 22 of the upper cap 12 includes an outer surface 64 and optionally a plurality of ribs 66 extending from the outer surface 64 and from the first end 48 of the first tubular member 22 to the second end 50 of the first tubular member 22.

Still referring to FIGS. 1 through 6, in an embodiment, the lower cap 14 includes a first end 68, a second end 70 opposite the first end 68 of the lower cap 14, an interior portion 72 extending between the first end 68 of the lower cap 14 and the second end 70 of the lower cap 14, and a second tubular member 74 extending inwardly from the second end 70 of the lower cap 14. In an embodiment, the first end 68 of the lower cap 14 is adapted to be removably attached to the first end 204 of the container 200. In an embodiment, the second tubular member 74 of the lower cap 14 includes a first end 76 and a second end 78 opposite the first end 76 of the second tubular member 74. In an embodiment, the second tubular member 74 of the lower cap 14 further includes an inner wall 80 and at least one pin 82 extending radially inwardly from the inner wall 80 proximate to the second end 78 thereof. In an embodiment, the at least one pin 82 includes two pins 82. In an embodiment, the pins 82 are diametrically opposed to one another.

Figure 8:
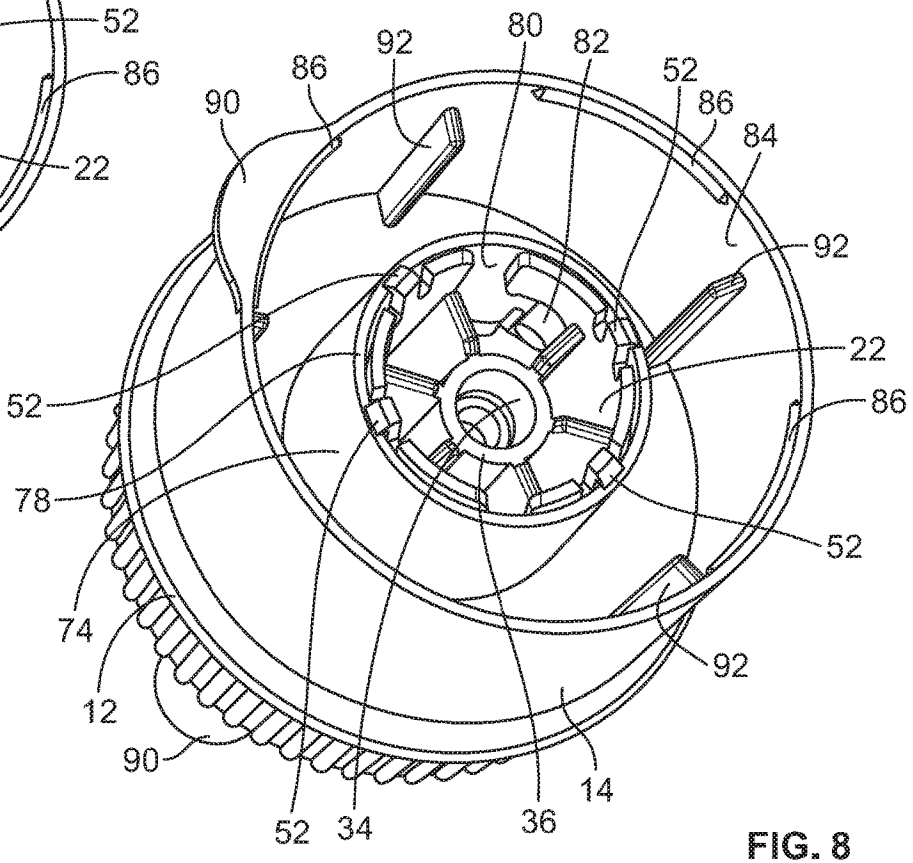
FIG. 8 is bottom perspective view of the applicator of FIG. 1 shown in a locked position.
Figure 7:
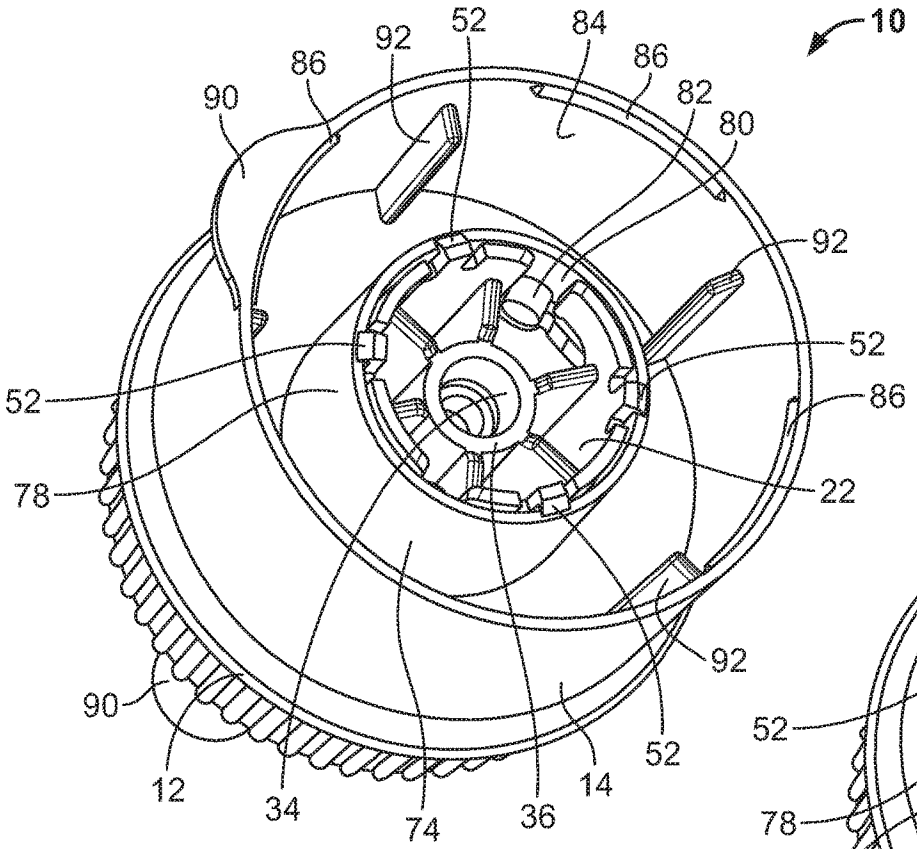
FIG. 7 is bottom perspective view of the applicator of FIG. 1 shown in an unlocked position.
Figure 9:
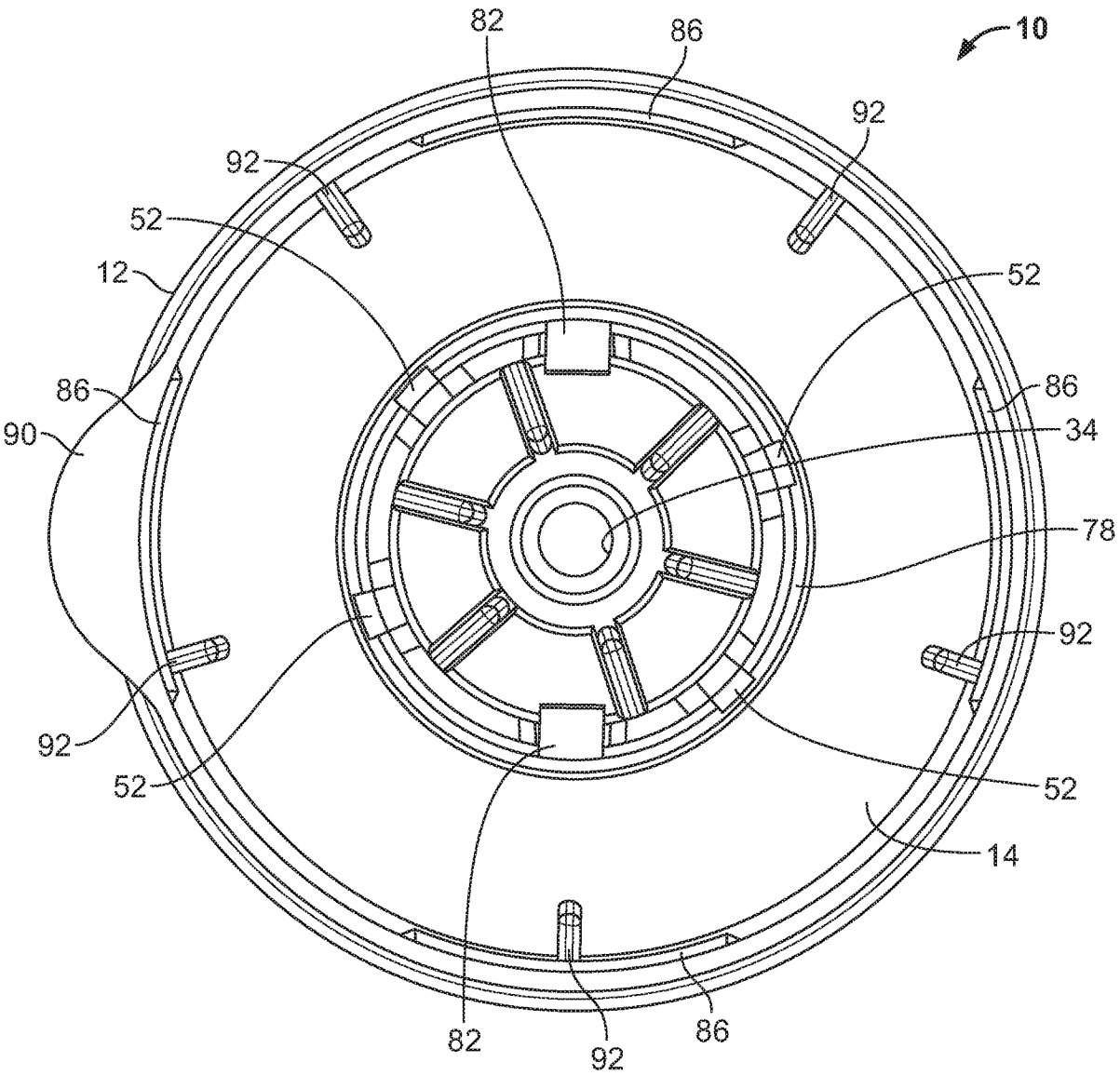
FIG. 9 is a bottom plan view of the applicator of FIG. 1.

Referring to FIGS. 7 through 9, in an embodiment, the lower cap 14 includes an inner wall 84 and at least one snap tab 86 extending from and circumferentially on the inner wall 84 and located proximate to the first end 68 of the lower cap 14, and wherein the at least one snap tab 86 is adapted to removably engage the first end 204 of the container 200 to removably install the applicator 10 on the container 200. In the embodiment, the at least one snap tab 86 includes a plurality of snap tabs 86. In an embodiment, the lower cap 14 includes an outer wall 88 opposite the inner wall 84 of the lower cap 14 and at least one enlarged tab 90 extending from the outer wall 88 of the lower cap 14. In an embodiment, the at least one enlarged tab 90 is sized and shaped to facilitate the installation of the applicator 10 to, and the release of the applicator 10 from, the container 200. In another embodiment, the at least one enlarged tab 90 includes a plurality of enlarged tabs 90. Referring to FIGS. 7 through 9, in an embodiment, the lower cap 14 includes at least one rib 92 extending radially inwardly from the inner wall 84. In an embodiment, the at least one rib 92 extends from the first end 68 of the lower cap 14 to a point intermediate the first and second ends 68, 70 of the lower cap 14. In an embodiment, the at least one rib 92 includes a plurality of the ribs 92. In an embodiment, the plurality of rubs 92 includes five of the ribs 92 circumferentially spaced-apart equally from one another. In an embodiment, the ribs 92 provide structural support for the inner wall 84. In an embodiment, the ribs 92 act as a stop when the first end 68 of the lower cap 14 is attached to the first end 204 of the container 200.

Referring to FIGS. 1 through 9, in an embodiment, the upper cap 12 is attached to the lower cap 14 such that the first tubular member 22 of the upper cap 12 is slidably inserted into the second tubular member 74 of the lower cap 14. In an embodiment, the locking tabs 52 of the first tubular member 22 of the upper cap 12 is adapted to releasably engage the second end 78 of the second tubular member 74 of the lower cap 14. In an embodiment, the plurality of ribs 66 is adapted to reduce friction between the outer surface 64 of the wall 54 of the first tubular member 22 of the upper cap 12 and the inner wall 80 of the second tubular member 74 of the lower cap 14.

Figure 10:
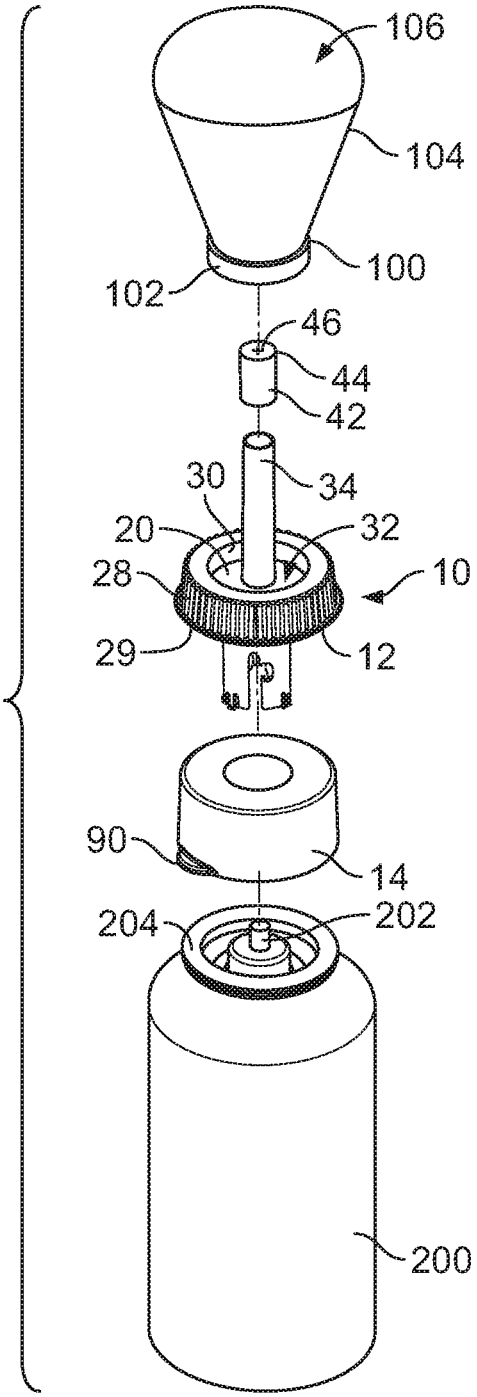
FIG. 10 is a view of the applicator of FIG. 1 attached to a container and having an applicator brush.
Figure 11:
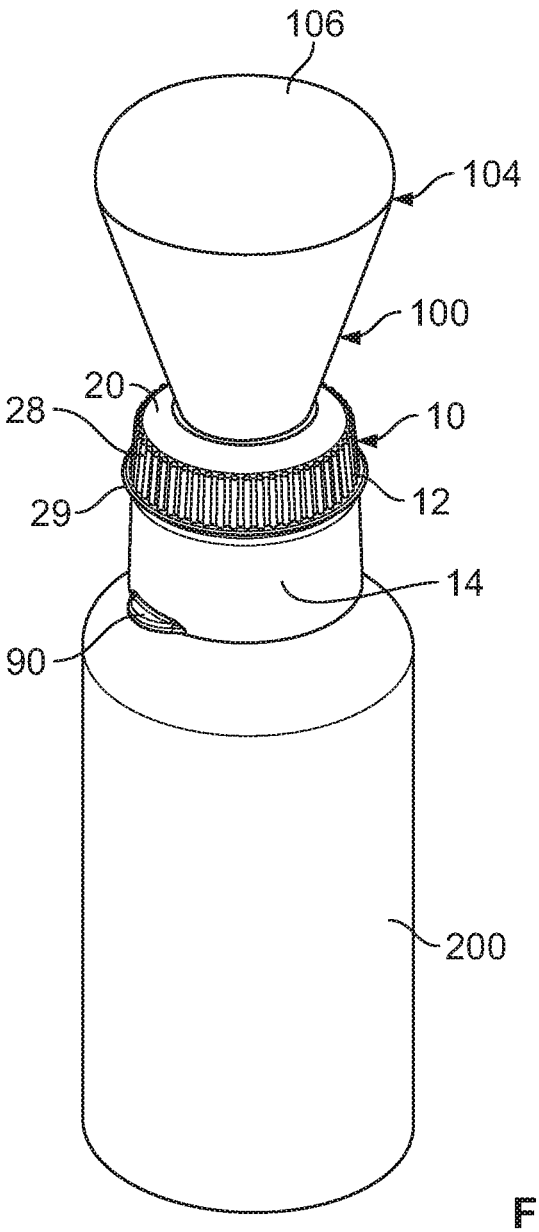
FIG. 11 is an exploded view of the applicator, container and brush shown in FIG. 10.

Referring to FIGS. 10 and 11, in an embodiment, the applicator 10 includes a brush 100 adapted to be slidably attached to the feed tube 34. In an embodiment, the brush 100 includes a brush base 102 that is sized and shaped to be installed within the recess 32 and inside the wall 30 of the upper cap 12. In an embodiment, the brush base 102 is attached to the second end 20 of the base 16 the upper cap 12 by an adhesive. In other embodiments, the brush base 102 is attached to the second end 20 of the base 16 by other suitable means known in the art, e.g., tabs, bayonet clips, friction fit, threads, etc. In an embodiment, the brush 100 is a shaving brush. In an embodiment, the brush 100 includes a bulb 104 with a plurality of bristles 106. In other embodiments, the brush 100 can consist of the shaving brushes shown and described in U.S. Design Pat. No. D850,116 S to Schmidt entitled "SHAVING BRUSH," the contents of which are incorporated by reference herein. In another embodiment, the bulb 104 is recessed within the recess 32 of the upper cap 12. In another embodiment, the brush 100 need not be utilized or included.

In an embodiment, the upper cap 12 is movable longitudinally relative to the lower cap 14. In an embodiment, the upper cap 12 is movable from a first position, in which the first end 36 of the feed tube 36 is disengaged with the valve 202 of the container 200, and a second position, in which the first end 36 of the feed tube 36 is engaged with the valve 202. In an embodiment, each of the first and second slots 56, 60 is adapted to receive a corresponding one of the pins 82, such that upper cap 12 and the lower cap 14 are moveable relative to one another from an unlocked position, in which the pins 82 are positioned in the corresponding first slots 56 and the upper cap 12 is moveable longitudinally relative to the lower cap 14, and a locked position, in which the upper cap 12 is rotatable relative to the lower cap 14 and the pins 82 are positioned within the corresponding second slots 60 such that the upper cap 12 is inhibited from moving longitudinally relative to the lower cap 14. In an embodiment, when the upper cap 12 is in its second position, it pushes the container valve 202 to an engaged position such that contents of the container 200 are released and conveyed through the feed tube 34 and expelled from the second end 38 of the feed tube 34. In an embodiment, the ribs 28 facilitate a user to rotate the upper cap 12 relative to the lower cap 14. In an embodiment, the ring 29 provides for a stop and another surface for a user's hand when manipulating the upper cap 12.

In an embodiment, the applicator 10 is adapted to dispense the contents of the container 200 inline vertically through the feed tube 34. As indicated above, the inner wall 40 of the feed tube 34 tapers radially inwardly from the first end 36 to the second end 38, such that the second end 38 has a larger inner diameter. This reduces the pressure of the contents expelled to prevent too much of the contents exiting too fast. In an embodiment, the valve 42 of the applicator 10 is a one-way valve, such that the contents of the container 200 is expelled out through the slit 46, but the slit 46 closes after use of the applicator 10. This assists in the prevention of drying of residual contents in the feed tube 34 to prevent blockage therein.

In an embodiment, the container 200 includes an aerosol shaving can, the contents of which being shaving fluid. In an embodiment, the shaving fluid is fed through the feed tube to the bristles of the shaving brush. In an embodiment, the shaving fluid can be shaving cream or shaving gel. In another embodiment, the container 200 includes an aerosol paint can, the contents of which being paint. In other embodiments, the container 200 can be other types of aerosol cans having associated pressurized contents, such as cleaners, insulation foams, lubricants, and other health and beauty products.

All such variations and modifications are intended to be included within the scope of the invention as defined in the appended claims.

What is claimed is:

1. An applicator, comprising an upper cap including a base having a first end, a second end opposite the first end, a first tubular member extending from the first end of the base and having an interior portion, and a feed tube having a first end located within the interior portion of the first tubular member, and a second end extending outwardly from the second end of the base, wherein the first end of the feed tube is adapted to engage a valve extending from a first end of a container; and a lower cap having a first end, a second end opposite the first end of the lower cap, an interior portion extending between the first end of the lower cap and the second end of the lower cap, and a second tubular member extending inwardly from the second end of the lower cap, wherein the first end of the lower cap is adapted to be removably attached to the first end of the container, wherein the upper cap is attached to the lower cap such that the first tubular member of the upper cap is slidably inserted into the second tubular member of the lower cap, wherein the upper cap is movable longitudinally relative to the lower cap from a first position, in which the first end of the feed tube is disengaged with the valve of the container, and a second position, in which the first end of the feed tube is engaged with the valve of the container and pushes the valve to an engaged position such that contents of the container are released therefrom and conveyed through the feed tube and expelled from the second end of the tube.

2. The applicator of claim 1, wherein the first tubular member of the upper cap includes a first end, a second end opposite the first end of the first tubular member, and at least one locking tab extending from the second end of the first tubular member, wherein the second tubular member of the lower cap includes a first end and a second end opposite the first end of the second tubular member, and wherein the at least one locking tab of the first tubular member of the upper cap is adapted to releasably engage the second end of the second tubular member of the lower cap.

3. The applicator of claim 2, wherein the second tubular member of the lower cap includes an inner wall and at least one pin extending radially inwardly from the inner wall proximate to the second end thereof, wherein the first tubular member of the upper cap includes a wall having at least one first slot formed therein and extending from the second end of the first tubular member to a closed end intermediate the first and second ends of the first tubular member, and at least one second slot circumferentially formed therein and extending from the corresponding at least one first slot, wherein each of the at least one first and second slots is adapted to receive a corresponding one of the at least one pin such that upper cap and the lower cap are moveable relative to one another from an unlocked position, in which the at least one pin is positioned in the at least one slot and the upper cap is moveable longitudinally relative to the lower cap, and a locked position, in which the upper cap is rotatable relative to the lower cap and the at least one pin is positioned within the at least one second slot such that the upper cap is inhibited from moving longitudinally relative to the lower cap.

4. The applicator of claim 3, wherein the at least one pin includes two pins, the at least one first slot includes two first slots, and the at least one second slot includes two second slots, wherein the two pins are diametrically opposed to one another, and each pair of corresponding first and second slots are diametrically opposed to one another.

5. The applicator of claim 1, wherein the lower cap includes an inner wall and at least one snap tab extending from and circumferentially on the inner wall and located proximate to the first end of the lower cap, and wherein the at least one snap tab is adapted to removably engage the first end of the container to removably install the applicator on the container.

6. The applicator of claim 5, wherein the at least one snap tab includes a plurality of snap tabs.

7. The applicator of claim 5, wherein the lower cap includes an outer wall opposite the inner wall of the lower cap and at least one enlarged tab extending from the outer wall of the lower cap, and wherein the at least one enlarged tab is sized and shaped to facilitate the installation of the applicator, and release of the applicator from, the container.

8. The applicator of claim 1, wherein the base of the upper cap includes an outer wall having gripping means.

9. The applicator of claim 8, wherein the gripping means includes a plurality of ribs.

10. The applicator of claim 8, wherein the gripping means includes a plurality of gripping dots.

11. The applicator of claim 8, wherein the gripping means includes a tactile material.

12. The applicator of claim 1, wherein the feed tube includes an inner wall that tapers radially outwardly from the first end of the feed tube to the second end of the feed tube.

13. The applicator of claim 1, further comprising a brush adapted to be slidably attached to the tube.

14. The applicator of claim 1, wherein the base of the upper cap includes a centrally located recess formed within the second end thereof, and wherein the brush includes a brush base that is sized and shaped to be installed within the recess of the base of the upper cap.

15. The applicator of claim 14, wherein the brush base is attached to the upper cap by an adhesive.

16. The applicator of claim 13, wherein the brush includes a shaving brush having a bulb with a plurality of bristles, and the container includes an aerosol shaving can, the contents of which being shaving fluid, and wherein the shaving fluid is fed through the feed tube to the bristles of the shaving brush.

17. The applicator of claim 16, wherein the bulb is recessed within the recess of the upper cap.

18. The applicator of claim 16, wherein the shaving fluid is selected from the group consisting of shaving cream and shaving gel.

19. The applicator of claim 13, wherein the container includes an aerosol paint can, the contents of which being paint.

20. The applicator of claim 2, wherein the first tubular member of the upper cap includes at least one bayonet clip stop located at the second end of the first tubular member.

21. The applicator of claim 3, wherein the wall of the first tubular member of the upper cap includes an outer wall and a plurality of ribs extending from the outer wall and from the first end of the first tubular member to the second end of the first tubular member, and wherein the plurality of ribs is adapted to reduce friction between the outer wall of the first tubular member of the upper cap and the inner wall of the second tubular member of the lower cap.

22. The applicator of claim 1, wherein the applicator is adapted to dispense the contents of the container inline and axially through the feed tube.

23. The applicator of claim 1, wherein the feed tube includes a valve positioned at the second end thereof, wherein the valve of the feed tube includes a one-way slit to enable the release of the contents from the container.

24. The applicator of claim 5, wherein the lower cap includes at least one rib extending radially inwardly from the inner wall of the lower cap.

25. The applicator of claim 24, wherein the at least one rib includes a plurality of ribs.

* * * * *